US005795057A

United States Patent [19]

Weigert

[11] Patent Number: 5,795,057

[45] Date of Patent: Aug. 18, 1998

[54] ASYMMETRICAL LAMP

[75] Inventor: Dedo Weigert, Munich, Germany

[73] Assignee: Dedo Weigert Film GmbH, Munich, Germany

[21] Appl. No.: 821,655

[22] Filed: Mar. 20, 1997

Related U.S. Application Data

[63] Continuation-in-part of Ser. No. 422,882, Apr. 17, 1995, Pat. No. 5,674,001.

[51] Int. Cl.[6] ..... F21V 13/04

[52] U.S. Cl. ..... 362/268; 362/299; 362/308; 362/327

[58] Field of Search ..... 362/268, 298, 362/299, 300, 307–309, 327, 328

[56] References Cited

U.S. PATENT DOCUMENTS

| | | | |
|---|---|---|---|
| Re. 14,102 | 4/1916 | Churchill | 362/280 |
| 933,614 | 9/1909 | Betts | 362/282 |
| 1,648,198 | 11/1927 | Ryan | 362/287 |
| 1,654,391 | 12/1927 | Thornton | 362/308 |
| 3,124,309 | 3/1964 | Cantoni et al. | 362/282 |
| 3,887,800 | 6/1975 | Johnson | 362/268 |
| 3,999,056 | 12/1976 | Faulhaber | 362/268 |
| 4,811,174 | 3/1989 | Kanzler et al. | 362/299 |
| 5,113,330 | 5/1992 | Makita | 362/61 |
| 5,158,350 | 10/1992 | Sato | 362/61 |
| 5,258,686 | 11/1993 | Segoshi et al. | 362/61 |
| 5,453,902 | 9/1995 | Watanabe et al. | 362/61 |
| 5,582,480 | 12/1996 | Zwick et al. | 362/299 |

FOREIGN PATENT DOCUMENTS

| | | | |
|---|---|---|---|
| 643578 | 9/1928 | France | 362/287 |
| 44 13 111 A1 | 4/1994 | Germany . | |
| 359752 | 10/1931 | United Kingdom | 362/282 |

OTHER PUBLICATIONS

Dedolight, Jul. 1989, 8 pages.

*Primary Examiner*—Alan Cariaso
*Attorney, Agent, or Firm*—Griffin, Butler, Whisenhunt & Szipl

[57] ABSTRACT

An asymmetrical lamp has a main lens (2), a reflector (3) and at least one light source arranged between the reflector (3) and the main lens (2). In order to achieve a uniform illumination of all areas of an object, even when the lamp is not positioned on an axis extending 90° to the object, the light source (1) and the reflector (3) are offset from an optical axis (6) of the main lens (2). The main axes (4, 5) of the light source (1) and the reflector (3) are, further, inclined to the optical axis (6) of the main lens (2). Preferably, the offset of the light source (1) and the reflector (3) relative to the optical axis (6) of the main lens (2), and the inclination of the main axes (4, 5) of the light source (1) and the reflector (3) to the optical axis (6) of the main lens (2), is adjustable so that the lamp can be optimally adjusted. In one embodiment an additional lens (7) is included between the light source and the main lens. In a further embodiment an eccentrically-positioned mirror (10, 11) is included at a surface of such an additional lens (7, 7") for reflecting light back toward the reflector.

8 Claims, 9 Drawing Sheets

ASYMMETRICAL LAMP

BACKGROUND OF THE INVENTION

This application is a continuation-in-part of U.S. patent application Ser. No. 08/422,882, filed Apr. 17, 1995, now U.S. Pat. No. 5,674,001.

This invention concerns lamps of a type having a main lens, a reflector, and at least one light source arranged between the reflector and the main lens.

Such a lamp is disclosed in a July 1987 published prospectus entitled "DEDOLIGHT" of Dedo Weigert Film GmbH.

If a flat object is illuminated by a lamp which is not positioned directly on an axis extending perpendicular to, or at 90° to, the object, a distance from the light source to one end of the object is greater than that to the other end of the object.

Because the light intensity of conventional light sources, at increasing distances, is reduced by a factor of four, a non-uniform illumination of the flat object results therefrom.

For example, illumination of a painting 16 hung on a wall 14 in a museum is shown in FIG. 7. In order to illuminate the painting 16, a lamp 10 attached to a ceiling 12 is used. The lamp 10 is arranged at such an angle to the painting 16 that observers of the painting 16 are positioned outside of a light cone 18 of the lamp, thus, they do not throw a shadow on the painting 16. The observers should not only be afforded a free line-of-sight to the painting 16 but should also not see bothersome reflections from the surface of the painting 16.

With such an arrangement, the lamp 10 can, for example, be spaced twice as far from a lower edge of the painting 16 as from its upper edge. In this case, the lower edge receives only 25% of the light intensity received by the upper edge; that is, the light intensity at the upper picture frame is four times as great as it is at the lower picture frame.

In the above described "DEDOLIGHT" lamp a particular optical system produces a uniform light-distribution curve as is shown in FIG. 8. With this lamp a desired illumination of a painting is possible. With appropriate predetermined elements, such as flaps or gates, illumination can be partitioned, or shaded, so that the surroundings of the painting do not receive scattered light. With such a lamp, a uniform light intensity in a horizontal direction can be achieved when the painting 16 and the lamp 10 are arranged as shown in FIG. 7. In a vertical direction, however, the light intensity decreases because of the different distances of the lamp from the upper and lower edges of the painting.

A lamp would be suitable for achieving a uniform light intensity in a vertical direction, in an ideal case, if it had a light-distribution curve with a parabolic shape, which falls steeply from its highest point to zero. The highest point corresponds to light intensity of light beams directed toward the lower painting edge. Such a light-distribution curve is shown in FIG. 10.

A substantially correct illumination can also be achieved with a lamp that has a bell-shaped light-distribution curve, as is shown in FIG. 9, such that a point of the highest light intensity lies on the lower edge of the painting. The remainder of light radiation which falls below the painting, is, in this case, partitioned, or shaded. The resulting light-distribution curve is shown in FIG. 11. This means that necessary energy, in a best case, can only be half used and, nevertheless, an ideal illumination can still not be achieved because the bell-shaped light-distribution curve does not have the required parabolic shape.

It is an object of this invention to provide a lamp with structurally uncomplicated parts which makes possible an optimal illumination of an object, even when the lamp is not directly on an axis extending at an angle of 90° to the object.

SUMMARY OF THE INVENTION

According to principles of this invention, in a lamp of the type described in the introductory paragraph above, a light source and a reflector are arranged to be offset from an optical axis of a main lens and main axes of the light source and the reflector are inclined relative to the optical axis of the main lens. An additional lens is included between the light source and the main lens, with a mirror covering a portion of the additional lens for reflecting light from the light source back to the reflector.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

Figure 1:
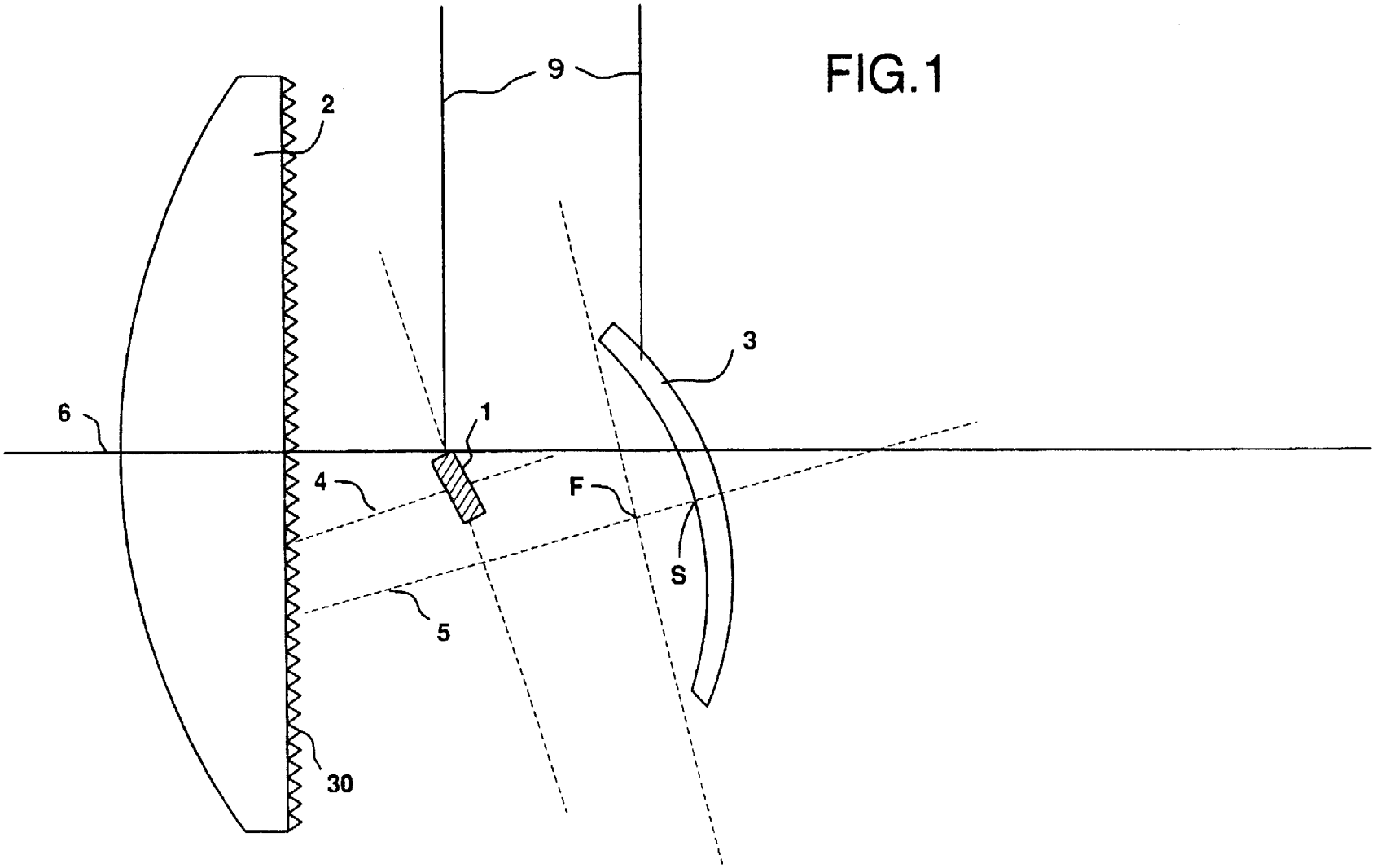
FIG. 1 is a schematic cross-sectional view of a first embodiment of an asymmetrical lamp of this invention.
Figure 2:
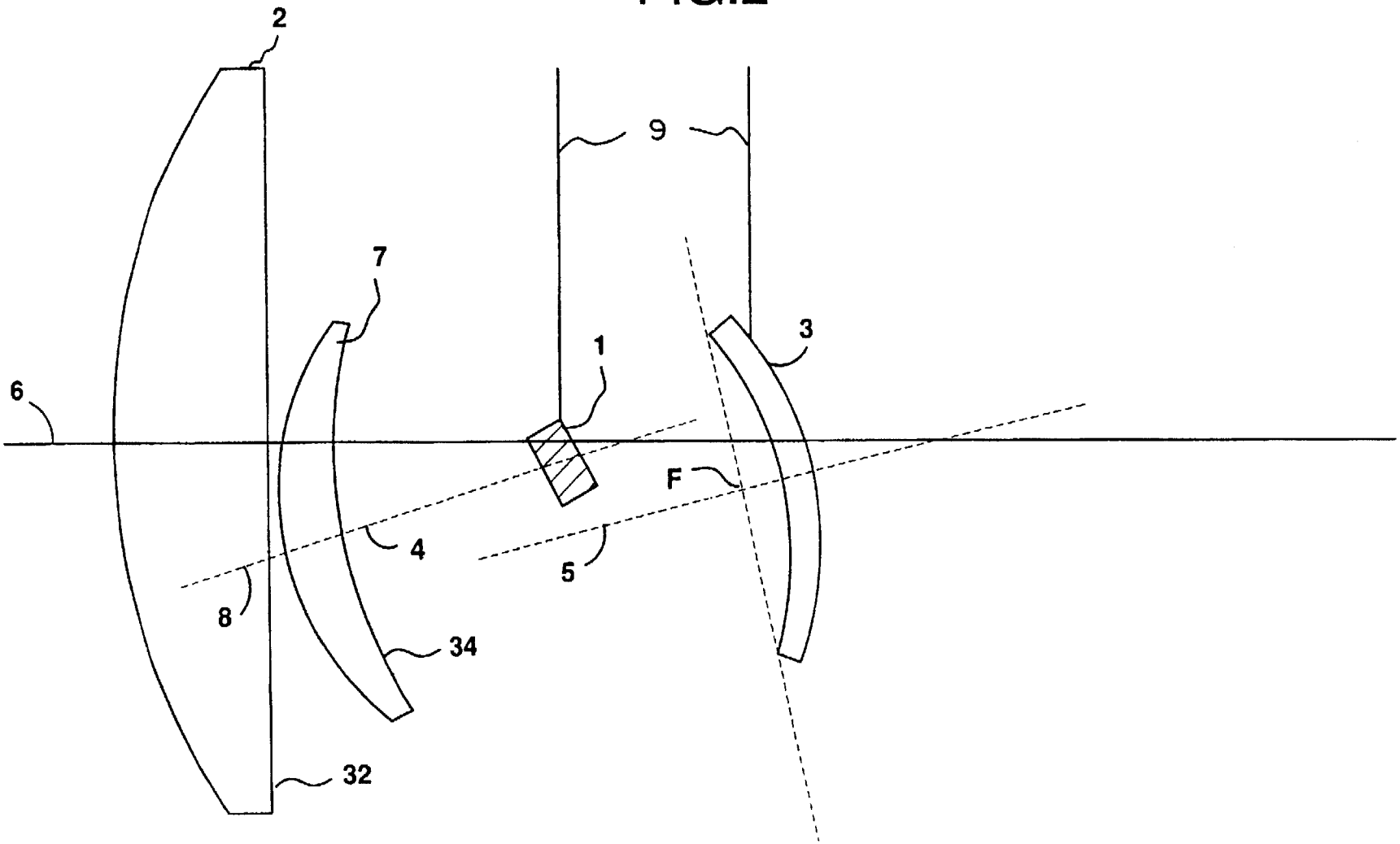
FIG. 2 is a schematic cross-sectional view of a second embodiment of an asymmetrical lamp of this invention which is similar to the embodiment of FIG. 1.
Figure 7:
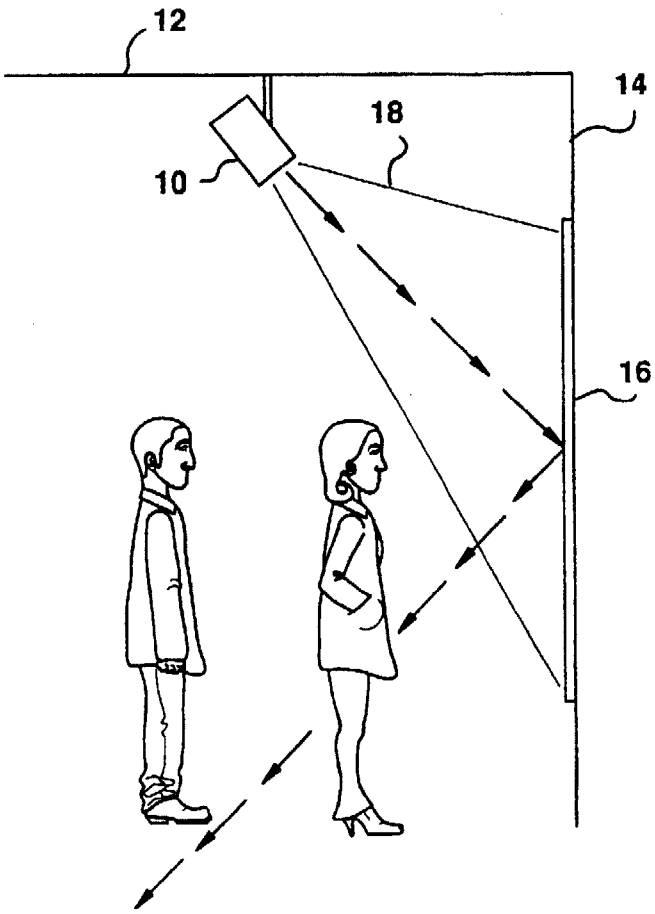
Figure 6A:
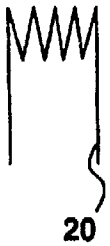
Figure 6B:
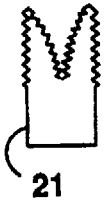
Figure 6C:
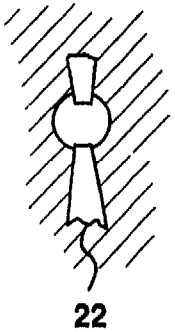
Figure 6D:
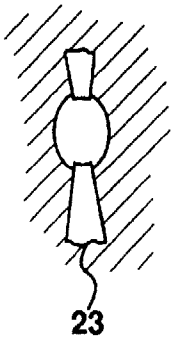
Figure 8:
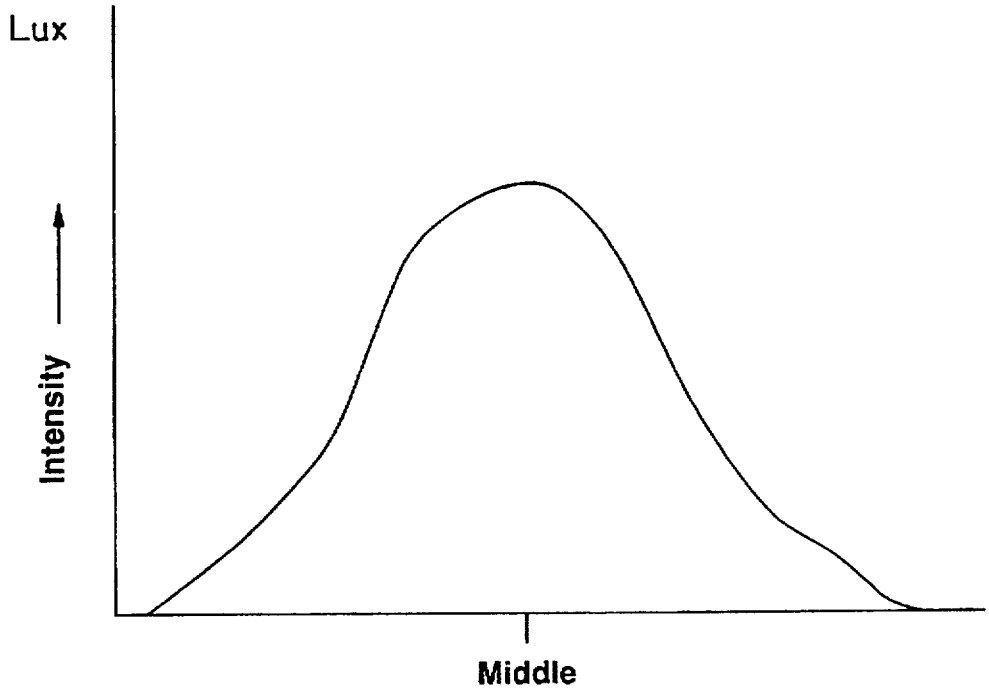
Figure 9:
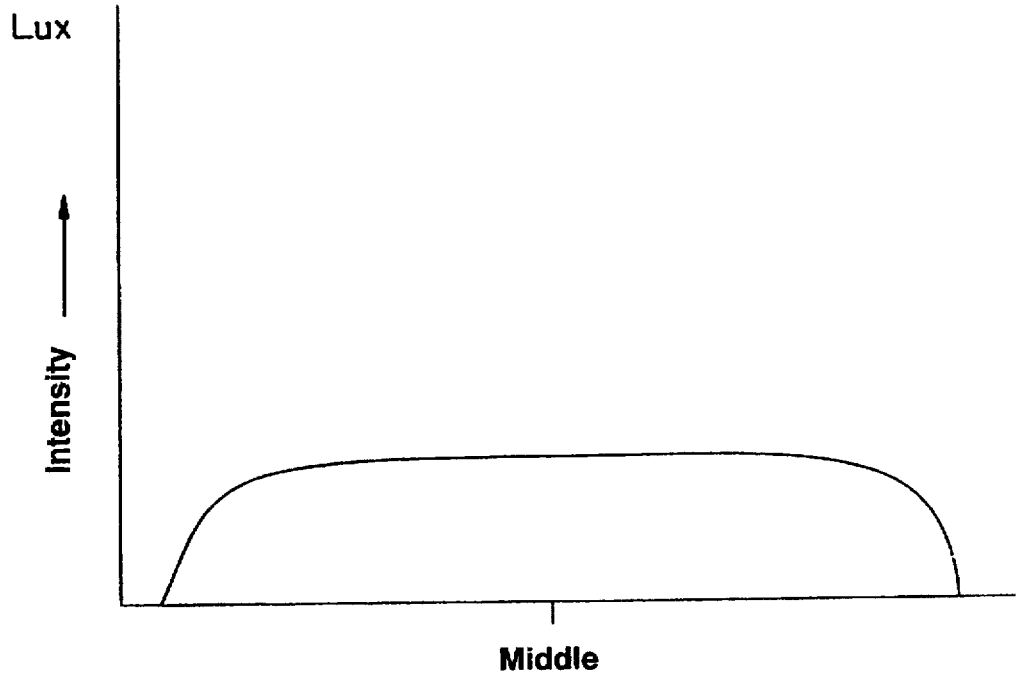
Figure 10:
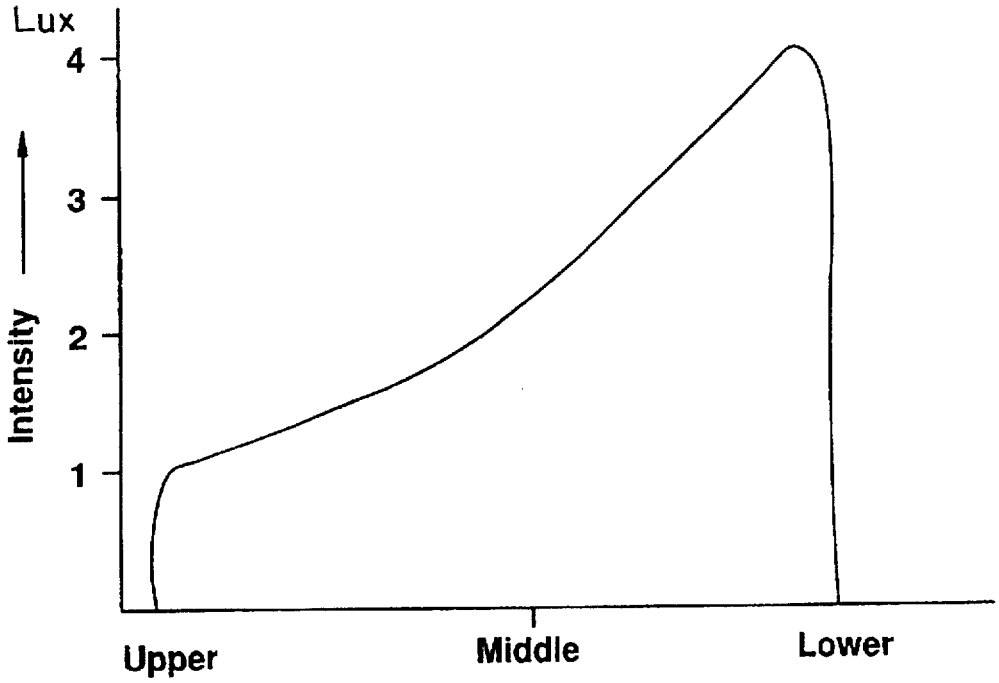
Figure 11:
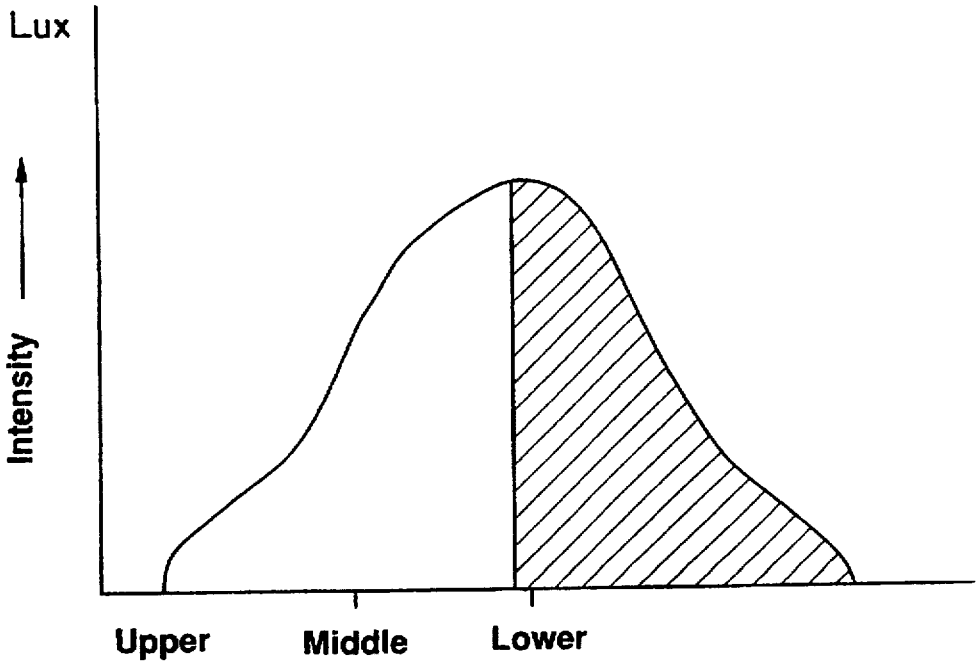
Figure 12:
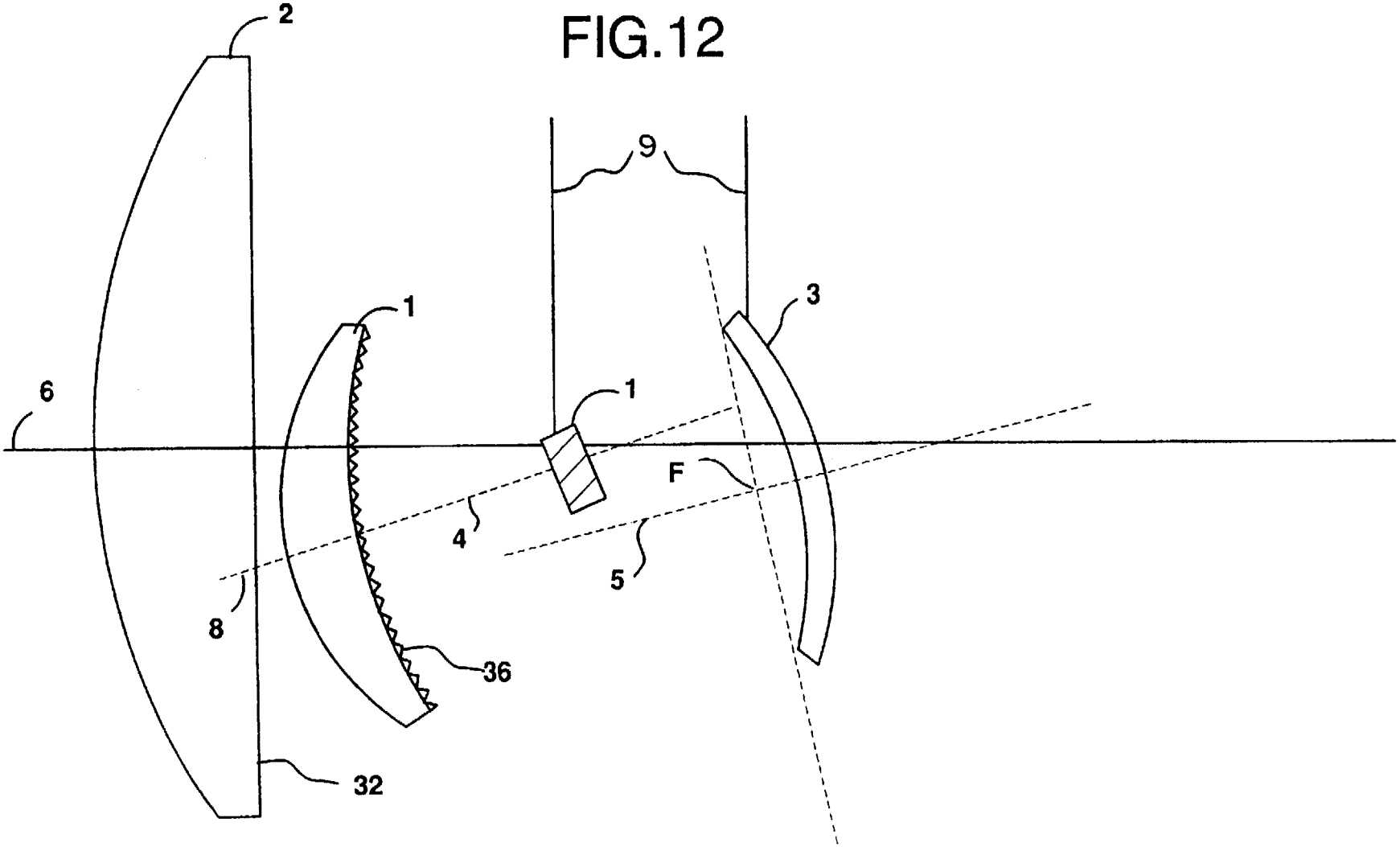
Figure 13:
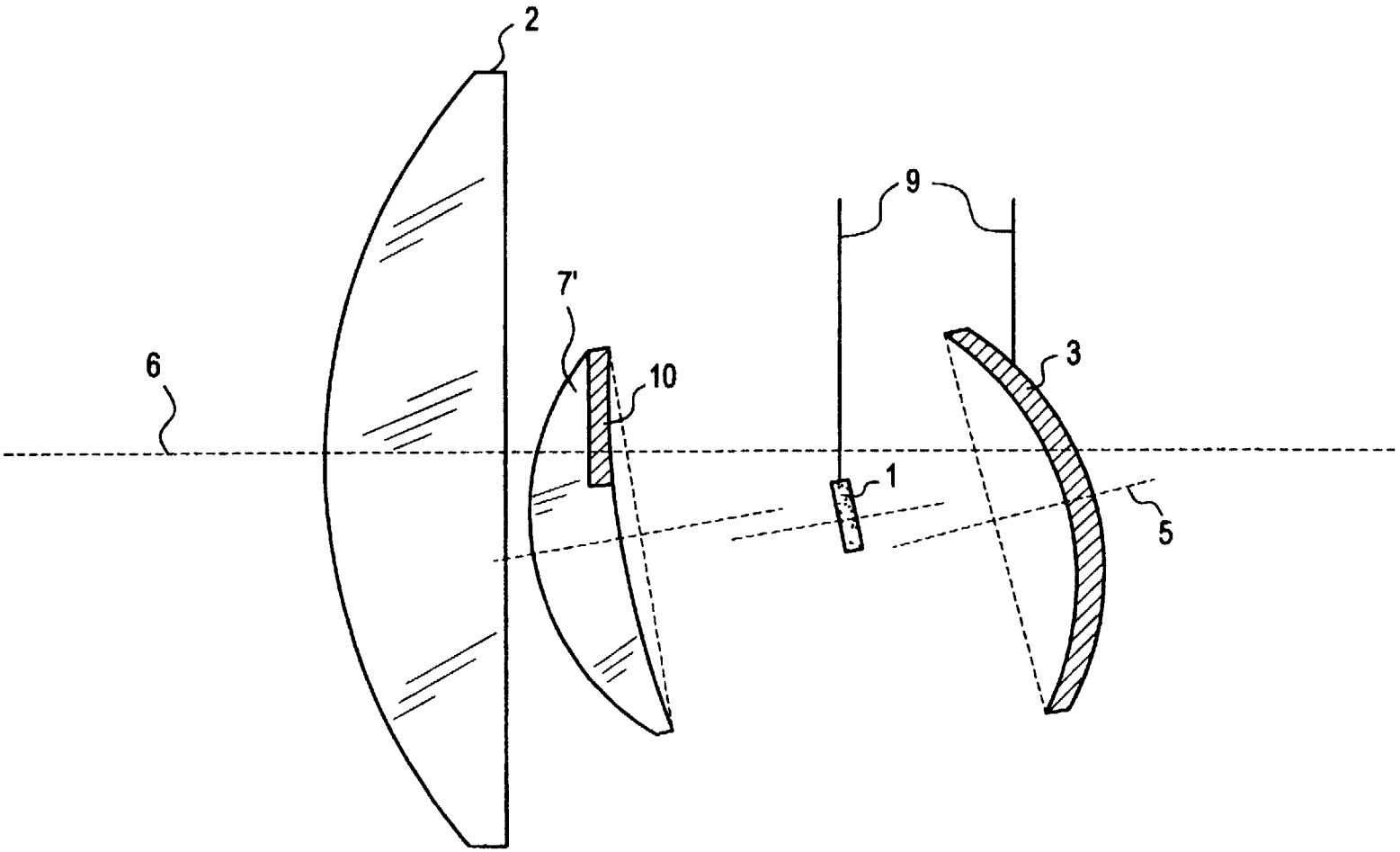
Figure 14:
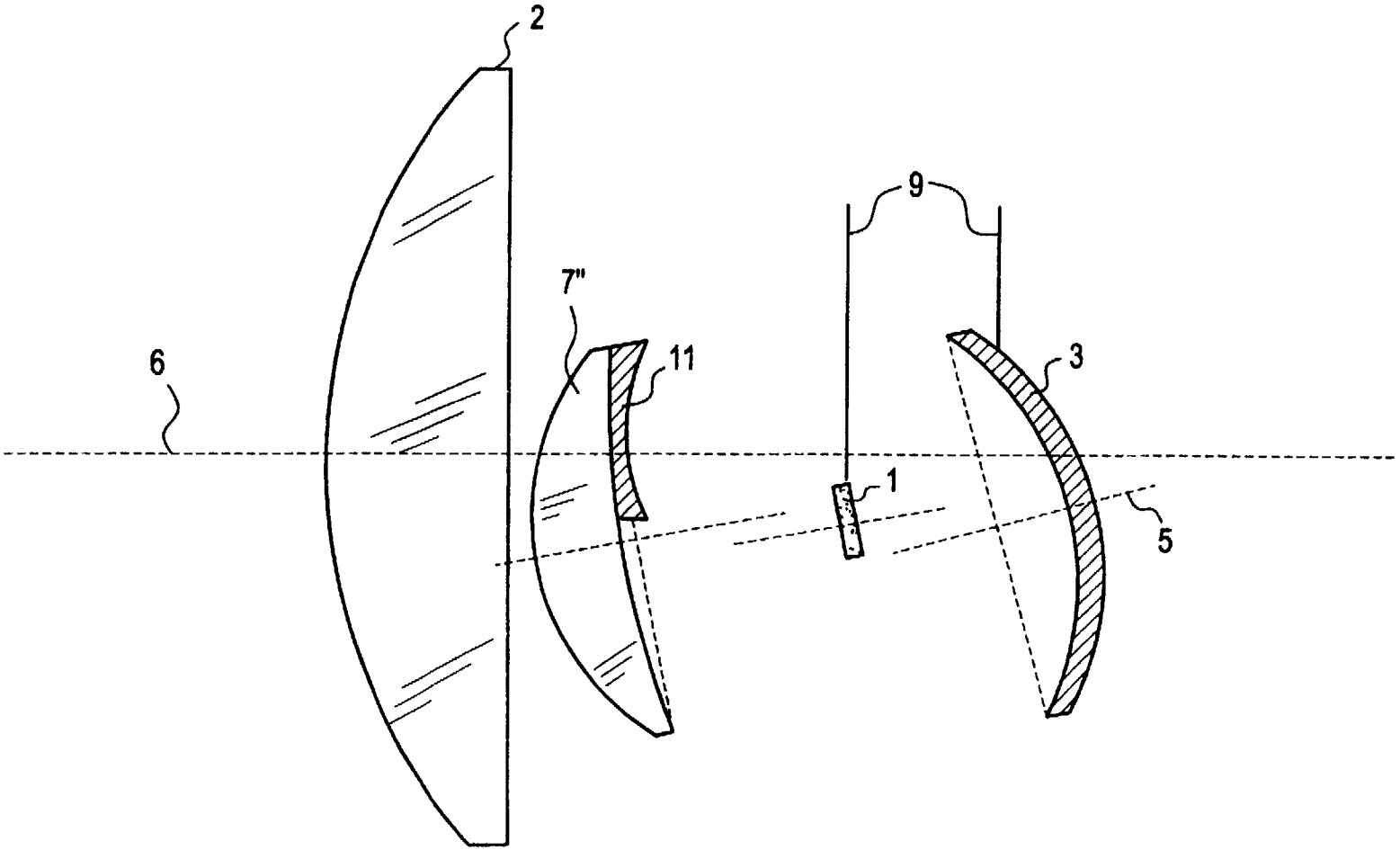

Each of FIGS. 6A, B, C and D discloses a possible light source for the lamp of FIG. 1;

FIG. 7 is a schematic side view of illumination of a painting in a museum with observers standing in front of the painting;

FIG. 8 is a diagram of a bell-shaped light-distribution curve of a known lamp;

FIG. 9 is a diagram of a light intensity distribution curve of a known "DEDOLIGHT" lamp;

FIG. 10 is a diagram of an ideal light-distribution curve for illuminating a flat object from an angle;

FIG. 11 is a diagram of a light-distribution curve of a partitioned, known, lamp with a bell-shaped light-distribution curve;

FIG. 12 is a schematic cross-sectional view of a third embodiment of an asymmetrical lamp of this invention which is similar to the embodiment of FIG. 2; and FIGS. 13 and 14 are schematic cross-sectional views of further embodiments of an asymmetrical lamp according to this invention.

DESCRIPTION OF THE PREFERRED EMBODIMENT

The lamp shown in FIG. 1 has a main lens 2 which is formed as a plano-convex condenser lens. A reflector 3, formed as a concave mirror, is further provided at a distance from the main lens 2, with the concave mirror's surface facing the plano-surface of the main lens 2. The reflector 3 is offset, or displace, from an optical axis 6 of the lens such that a focal point F and an apex S of the reflector are spaced from the optical axis 6. Further, the reflector 3 is inclined to the main lens 2 so that a main axis 5 of the reflector 3 extends at an angle to the optical axis 6 of the main lens.

A light source 1 is arranged between the reflector 3 and the main lens 2. A plurality of possible light sources 1 are represented in FIGS. 6A–6D. The light source is a type of light source with a small diameter, for example, a bulb with a small filament. If a small voltage halogen lamp is used, a flat core filament 20 is useful. For projection lamps, it is beneficial to employ a folded filament 21. Further, discharge lamps with small circularly shaped light sources 22 or elliptical-type light sources 23 are suitable.

The light source 1 is arranged to be displaced from the optical axis 6 of the main lens 2 in the same direction as is the reflector 3. If a filament is used, the middle of the filament is positioned to be offset from, or displaced from, the optical axis 6 of the main lens 2. Further, a main axis 4, that extends perpendicular to, and from the center of, the filament, is inclined, relative to the optical axis 6 of the lens 2, at a similar or identical angle as is the main axis 5 of the reflector 3.

A plurality of adjusting devices 9 are provided in the lamp with which the offset and the inclination of the light source 1 and the reflector 3, relative to the optical axis 6 of the lens 2, can be adjusted as desired for achieving a uniform light intensity distribution in all areas of an illuminated object. The spacing between the light source 1 and the reflector 3, as well as their positions about, and angles to, the optical axis 6 can be adjusted.

In the shown embodiment, the optical axis 6 and the main axes 4, 5 lie in the same plane. Such an embodiment is suitable for a situation where the lamp is positioned centrally above an object to be illuminated.

For an eccentric illumination, however, it may be necessary to place the main axes 4, 5 so that they do not intersect the optical axis 6, but rather so that they extend in a parallel plane to, or skewed to, the optical axis 6.

The lamp shown in FIG. 2 differs from the lamp of FIG. 1 in that between the light source 1 and the main lens 2 a meniscus-shaped additional lens 7 is arranged such that its convex surface is facing the plano surface of the main lens 2. An intersection point of a main axis 8 of the additional lens 7 with the additional lens 7 is also spaced from the optical axis 6 of the main lens 2. Further, the optical axis 8 of the additional lens 7 is similarly inclined to the optical axis 6 as are the main axes 4, 5. The offset and inclination of the additional lens 7 relative to the optical axis 6 of the main lens 2 is also adjustable by means of an adjusting apparatus 9. By means of the arrangement of the additional lens 7 a still more uniform light intensity distribution is achieved.

Figure 3:
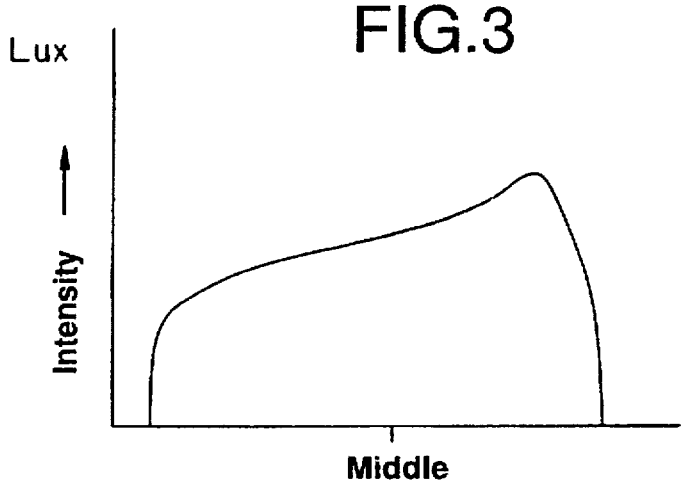
FIG. 3 is a diagram showing a light-distribution curve for illumination of a painting which illustrates the effect on light intensity of offsetting and inclining a light source relative to an optical axis of a lens.

FIG. 3 shows a light-distribution curve of light radiation caused by the light source 1 and the main lens 2 which results from the displacement and inclination of the light source 1 to the optical axis 6 of the main lens 2.

Figure 4:
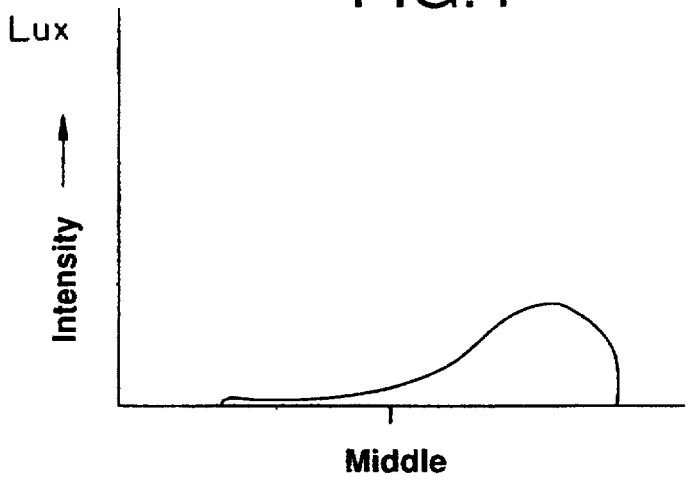
FIG. 4 is a diagram similar to that of FIG. 3 which shows the effect on light intensity of offsetting and inclining a reflector relative to an optical axis of a lens.

FIG. 4 shows a light-distribution curve of a complementing illumination which is achieved by the light source 1, the reflector 3 and the main lens 2.

Figure 5:
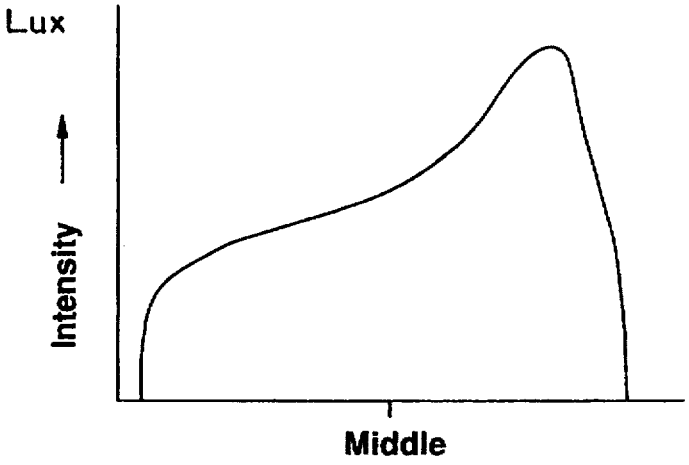
FIG. 5 is a diagram which shows the light-distribution curve of the lamp of FIG. 1.

The addition of the light-distribution curves shown in FIGS. 3 and 4 results in the light-distribution curve in FIG. 5.

It can be recognized that the light-distribution curve shown in FIG. 5 substantially corresponds to an ideal light-distribution curve shown in FIG. 10. Appropriate choice of the displacement, or offset, and the inclination of the light source 1, the reflector 3 and possibly the additional lens 7, allows attainment of an almost ideal light-distribution curve so that it is possible, with a lamp according to this invention, to illuminate all areas of an object with uniform light intensity.

With the inventive arrangement of this lamp it is possible to illuminate all areas of an object with uniform light intensity when the lamp is inclined relative to the illuminated object. The offset and the inclination of the light source and the reflector relative to the optical axis of the main lens depends upon the inclination of the optical axis of the main lens relative to the object. The light-distribution curve of the lamp according to this invention allows a full exploitation of light energy since practically no light appears beyond the object to be illuminated. It is thereby important that the radiated light has the shape of an asymmetrical light cone beyond which no scattered light is created.

Use of a lamp of this invention is not limited to a vertical displacement. The displacement can, according to need, also be horizontal or diagonally upward or downward. In other words, the asymmetry can be arranged to move circularly about the optical axis of the main lens. This allows an eccentric mounting of the lamp relative to the horizontal and vertical axes of an object to be illuminated.

The lamp of this invention is particularly suited for illuminating paintings in museums. It can, however, also be employed for all types of illuminating in which a uniform light distribution on an object is necessary and in which the lamp cannot be mounted at a middle axis perpendicular to an object.

There exists trick tables on which cameras are mounted above an object, directed downwardly. In this case, in the past, two lamps have normally been applied to achieve a uniform illumination.

By use of the lamp of this invention, only a single lamp which is arranged outside of an axis perpendicular to a picture middle is necessary. Basically, in this manner, every flat surface object can be uniformly illuminated from a corresponding angle. A statue can also be illuminated by a lamp of this invention when the lamp is directed upwardly at an angle. The head of the statue then receives the same light intensity as the feet of the statue.

With a central mounting of the lamp relative to a vertical and a horizontal axes of an object it is useful to have the main axis of the light source and the reflector, as well as the optical axis of the main lens, lying in a single plane.

If a lamp of this invention has apparatus which allow adjustment of offset of the light source and the reflector from the optical axis of the main lens, and of inclination of the main axes of the light source and the reflector relative to the optical axis of the main lens, the lamp of this invention can be quickly and uncomplicatedly adapted to illuminate a particular object. The lamp is arranged at a particular angle to a painting. Finally, the offset and inclination are adjusted so that all areas of the illuminated object are illuminated with the same light intensity.

Preferably, a surface of the main lens is cut and etched 32 or provided with a grain structure 30. The crystal structure of a raw cut and etched lens, as well as a grain of a lens surface, serves as a plurality of micro lenses which scatter light beams within the light cone without creating bothersome scattered light or reducing light transmission.

A particularly good adaptation to the ideal curve is possible if an additional lens is arranged between the light source and the main lens to be relatively offset from the optical axis of the main lens, with the main axis of the additional lens being inclined to the optical axis of the main lens. The additional lens can be a plano-convex or a meniscus-shaped condenser lens. A surface of the additional lens can also be cut and etched 34 or provided with a grain, or frosted, structure 36.

According to further embodiments of an asymmetrical lamp of this invention, an additional lens 7' (FIG. 13) or 7" (FIG. 14) is arranged on a mirror 10, 11. A concave side of the mirror 10, 11 is facing the light source 1. The mirror 10, 11 is eccentrically positioned on the additional lens 7' or 7" to cover an upper portion (a portion nearer to, or at, the optical axis 6 of the main lens 2) of the additional lens 7', 7". Some of the rays from the light source 1 which radiate in the direction of the additional lens 7', 71" are now reflected back toward the reflector 3 by the upper portion, which is covered by the mirror 10, 11. These rays are again reflected from the reflector 3 through a lower portion of the additional lens 7', 7". After these rays have also passed through the main lens 2 they contribute to an asymmetrical distribution of the light. By use of this construction, a total amount of light available is more effectively used in the asymmetrical light distribution. There are fewer losses. Because the curvature radius of the mirror 10, 11 must not necessarily correspond to a curvature radius of the additional lens 7', 7" one can variably influence a light distribution curve. A particularly large variation is possible if the mirror 10, 11 is not fixed, but rather is adjustable and/or is mounted to be replaceable. In case of exchangeability, or replaceability, of the mirror 10, 11 a user can choose mirrors having various sizes and radii of curvature and, also in this manner, the light distribution curve of the lamp can be adapted to respective illumination requirements.

In another embodiment, instead of using the mirror 10, 11 a concave surface of the additional lens 7 can be coated to be, itself, a mirror, in order to obtain the same effect. In this embodiment, the curvature radius of the mirror surface is identical with the curvature radius of the concave surface of the additional lens.

While the invention has been particularly shown and described with reference to a preferred embodiment, it will be understood by those of ordinary skill in the art that various changes in form and detail may be made therein without departing from the spirit and scope of the invention.

The embodiments of the invention in which an exclusive property or privilege are claimed are defined as follows:

I claim:

1. A lamp comprising:

a main lens having a main-lens optical axis;

a reflector having reflector main axis, said reflector being arranged to be offset from the main-lens optical axis and said reflector main axis being inclined relative to the main-lens optical axis; and at least one light source arranged between the reflector and the main lens;

wherein a center of the light source is arranged offset from the main-lens optical axis and offset from the reflector main axis;

wherein an additional lens is arranged between the light source and the main lens to be offset from the main-lens optical axis whereby an additional-lens main axis of the additional lens is inclined to the main-lens optical axis; and wherein said lamp further includes a mirror covering a portion of said additional lens for reflecting light from said light source back toward said reflector.

2. A lamp as in claim 1 wherein said mirror has a radius of curvature which is identical to a radius of curvature of said additional lens.

3. A lamp as in claim 2 wherein said mirror is formed from a portion of the surface of said additional lens.

4. A lamp as in claim 1 wherein said mirror is formed from a portion of the surface of said additional lens.

5. A lamp as in claim 1 wherein said portion of said additional lens covered by said mirror is eccentrically located on said additional lens.

6. A lamp as in claim 5 wherein said portion of said additional lens covered by said mirror is near said main-lens optical axis.

7. A lamp as in claim 1 wherein said mirror is removably attached to said additional lens so that it can be replaced.

8. A lamp as in claim 1 wherein said mirror is attached at a concave surface of said additional lens and said mirror itself has a mirror concave surface facing said light source, but wherein said mirror concave surface has a different radius of curvature than does the concave surface of said additional lens.

* * * * *